United States Patent [19]

Bozinovic

[11] Patent Number: 4,609,196

[45] Date of Patent: Sep. 2, 1986

[54] ZIG-ZAG BALL

[76] Inventor: Zoran Bozinovic, Zrmanjska St. No. 8/26, 11000 Belgrade, Yugoslavia

[21] Appl. No.: 660,434

[22] Filed: Oct. 11, 1984

[51] Int. Cl.[4] ..... A63B 71/00

[52] U.S. Cl. ..... 273/128 A; 446/437

[58] Field of Search ..... 273/128 R, 128 A, 143 C, 273/138 R, 58 F, 58 R, 1 M; 446/437

[56] References Cited

U.S. PATENT DOCUMENTS

| | | | |
|---|---|---|---|
| 996,458 | 6/1911 | Coleman | 273/128 A |
| 1,120,757 | 12/1914 | Steinberger | 273/580 |
| 2,859,968 | 11/1968 | Modica, Jr. | 273/128 A |
| 3,195,267 | 7/1965 | Gehlen | 273/128 A |
| 4,194,737 | 3/1980 | Farmer | 273/128 A |
| 4,257,605 | 3/1981 | Bancroft | 273/128 A |

*Primary Examiner*—Richard C. Pinkham
*Assistant Examiner*—T. Brown
*Attorney, Agent, or Firm*—Willian Brinks Olds Hofer Gilson & Lione Ltd.

[57] ABSTRACT

A zig-zag ball useful as a toy or in sports is disclosed. The ball moves in a zig-zag manner when rolled out on a flat horizontal surface. The zig-zag movement is achieved by a mechanism placed inside the ball which alters the center of gravity of the ball as it rolls. One embodiment of the invention comprises a ball containing an internal shaft with engraved left and right threads, a hollow cylinder slideably mounted on the shaft, a weight attached to the cylinder and a pin on the cylinder contacting and following the threads on the shaft as the ball rolls and the cylinder turns on the shaft.

2 Claims, 1 Drawing Figure

ZIG-ZAG BALL

BACKGROUND OF THE INVENTION

This invention relates to a special kind of ball which moves in a zig-zag manner when rolled out on a flat horizontal surface. Such a ball is a toy or a sports requisite. As far as is known, a ball with similar characteristics has never been invented and/or made.

The object of this invention is to provide a ball suitable for an "anti-bowling" game, i.e. a game in which the aim is to roll the ball out in a bowling manner, with the intention to avoid obstacles distributed on a flat surface in front of the player.

SUMMARY OF THE INVENTION

The main characteristic of the zig-zag ball according to the invention is that the ball, rolling freely on a flat horizontal surface, travels along a sinusoidal path. This kind of movement is achieved by a mechanism placed inside the ball which causes the center of gravity of the ball to reciprocate in a repeating pattern as the ball rolls. One mechanism for achieving this result consists of a shaft with left and right threads traversing the hollow interior of the ball, a weight slidably supported on the shaft and a pin attached to the weight support which contacts the threads.

The same movement can be achieved by a mechanism consisting of a hollow endless spiral tube with a heavy metal ball running through it, or by a mechanism consisting of a system of balanced levers.

Additional features of the invention will be evident from the following description of a preferred embodiment of the invention, given by way of example only, and by reference to the appended drawing.

DESCRIPTION OF PREFERRED EMBODIMENT

Figure 1:
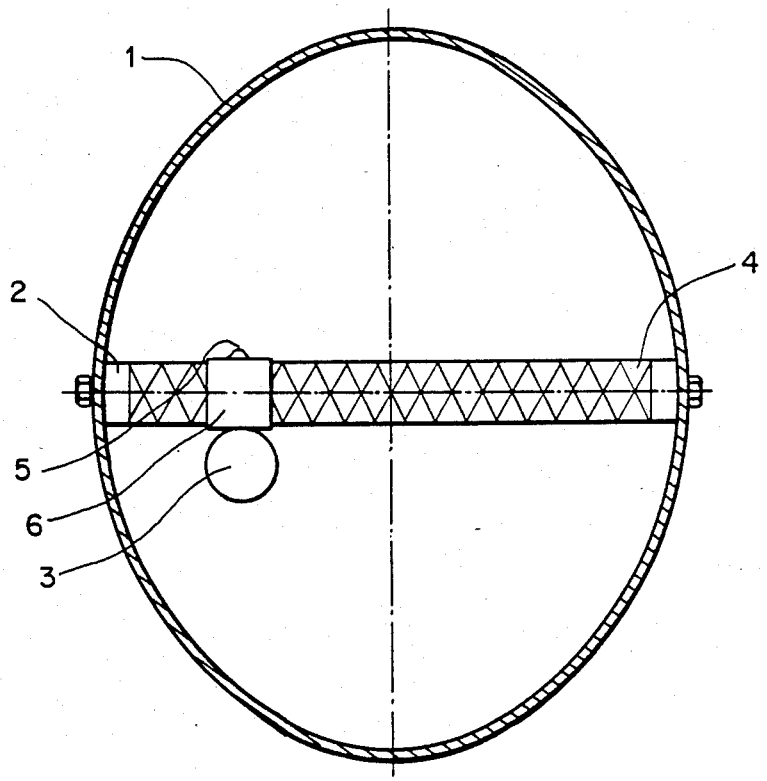
FIG. 1 is a vertical radial section view of a preferred embodiment of the ball of the present invention.

Referring to the drawing, the zig-zag ball according to the invention consists of a body 1, in which there is a shaft 2 with a left and right thread 4. A hollow cylinder

6 with a weight 3 and a pin 5 is slipped on the shaft 2. The pin 5 is in contact with the threads 4 engraved in the shaft 2.

While the ball is rolling, the body 1 and the shaft 2 are rotating, but the weight 3 does not permit rotation of the cylinder 6 slipped on the shaft 2. In that way, the weight 3, with the cylinder 6 and the pin 5, is forced to move axially along the shaft 2, from one side to another. When the pin 5 comes to the end of the right thread, it continues following the left thread (and vice-versa), which means that the weight 5, the cylinder 6 and the pin 3 start moving to the other side of the ball. The consequence of that axial movement is an oscillation of the center of gravity of the whole device, from one side to another. That reciprocating oscillation forces the rolling ball to enter left or right turns, which results in a zig-zag movement of the ball.

I claim:

1. A ball which moves in a zig-zag manner when rolled comprising:

(a) a body, (b) a shaft traversing two points at opposite sides of the body, (c) left and right threads engraved on said shaft, (d) a hollow cylinder slideably mounted on said shaft, (e) a pin connected to said cylinder and slideably contacting said threads and (f) a weight attached to said cylinder such that said weight, pin and threads cooperate to cause said cylinder to reciprocatingly traverse said shaft as said ball rolls.

2. A ball which moves in a zig-zag manner when rolled comprising a body and means inside said body for altering the center of gravity of the ball in a reciprocating manner as the ball rolls comprising:

a shaft transversing a diameter of said ball and attached at points at opposite sides of said body, (b) left and right threads engraved on said shaft, (c) a means mounted on said shaft, (d) a pin connected to said means and slideably contacting said threads and (e) a weight attached to said means.

* * * * *

UNITED STATES PATENT AND TRADEMARK OFFICE

CERTIFICATE OF CORRECTION

PATENT NO. : 4,609,196

DATED : September 2, 1986

INVENTOR(S) : Zoran Bozinovic

It is certified that error appears in the above-identified patent and that said Letters Patent is hereby corrected as shown below:

On the title page:

IN SECTION [56] ENTITLED REFERENCES CITED - U.S. PATENT DOCUMENTS

In the Modica, Jr. reference, No. 2,859,968, please change the date from "11/1968" to --11/1958--.

IN THE BACKGROUND OF THE INVENTION

In column 1, line 11, please correct the quotation marks around "anti-bowling" by deleting the present marks in front of "anti" and substituting therefor beginning quotation marks.

IN THE CLAIMS

In Claim 2 (column 2, line 37), please insert --(a)-- in front of the first subparagraph beginning with the words "a shaft transversing a diameter".

Signed and Sealed this

Thirtieth Day of August, 1988

*Attest:*

DONALD J. QUIGG

*Attesting Officer*

*Commissioner of Patents and Trademarks*